US009030269B1

(12) United States Patent
Vaisman

(10) Patent No.: US 9,030,269 B1
(45) Date of Patent: May 12, 2015

(54) TUNABLE MICROSTRIP AND T-JUNCTION

(75) Inventor: Aaron Vaisman, Brooklyn, NY (US)

(73) Assignee: Scientific Components Corporation, Brooklyn, NY (US)

( * ) Notice: Subject to any disclaimer, the term of this patent is extended or adjusted under 35 U.S.C. 154(b) by 378 days.

(21) Appl. No.: 13/474,049

(22) Filed: May 17, 2012

(51) Int. Cl.
*H01P 5/12* (2006.01)
*H01P 7/08* (2006.01)

(52) U.S. Cl.
CPC ..... *H01P 7/082* (2013.01)

(58) Field of Classification Search
USPC ..... 333/124–129, 132
See application file for complete search history.

(56) References Cited

U.S. PATENT DOCUMENTS

| | | | | |
|---|---|---|---|---|
| 5,001,492 | A | 3/1991 | Shapiro et al. | |
| 5,021,755 | A | 6/1991 | Gustafson | |
| 5,909,155 | A | 6/1999 | Anderson et al. | |
| 5,982,251 | A | 11/1999 | Weinschel | |
| 6,005,519 | A | 12/1999 | Burns | |
| 6,624,729 | B2 | 9/2003 | Wright et al. | |
| 6,759,917 | B2 | 7/2004 | Ikurumi et al. | |
| 6,790,049 | B2 | 9/2004 | Kaylie et al. | |
| 6,946,999 | B1 | 9/2005 | Ryken et al. | |
| 7,015,772 | B2 | 3/2006 | Ji | |
| 2010/0060388 | A1 * | 3/2010 | Ueda | 333/236 |

OTHER PUBLICATIONS

Progress in Electromagnetics Research, PIER 49, 53-69, 2004 A.A. Eldek, et al. Characteristics of Bow-Tie Slot Antenna With Tapered Tuning Stubs for Wideband Operation, pp. 53-69.

* cited by examiner

*Primary Examiner* — Robert Pascal
*Assistant Examiner* — Kimberly Glenn
(74) *Attorney, Agent, or Firm* — Lawrence G. Fridman

(57) ABSTRACT

A tunable microstrip having removable contactless tuning stubs is used in the fabrication of a tunable T-junction circuit. Arrays of tuning stubs are formed in proximity to both sides of a microstrip signal trace. Each array of tuning stubs has a shared grounding bus connected by multiple vias to the ground plane. The sinusoidally patterned shape of the tuning stubs and their proximity to the signal trace provides a minimum breakdown voltage of 1.3 kV and a tuning sensitivity of approximately 0.01 dB to 0.02 dB.

31 Claims, 5 Drawing Sheets

| FREQUENCY (MHz) | Insertion Loss (above 4.77 dB) S-1 | S-2 | S-3 | Average Insertion Loss (dB) | Amplitude Unbalance (dB) | Insertion Phase (deg) S-1 | S-2 | S-3 | Phase Unbalance (nom. 0 deg) | Return Loss (dB) S | Group Delay (ns) S-1(Ref) | S-2(Ref) | S-3(Ref) |
|---|---|---|---|---|---|---|---|---|---|---|---|---|---|
| 1925.0000 | 0.11 | 0.10 | 0.15 | 0.13 | 0.04 | -29.41 | -31.41 | -28.53 | 2.88 | 29.69 | 0.00 | 0.00 | 0.01 |
| 1926.0000 | 0.11 | 0.10 | 0.15 | 0.13 | 0.04 | -29.61 | -31.62 | -28.74 | 2.88 | 29.71 | 0.00 | 0.00 | 0.00 |
| 1927.0000 | 0.11 | 0.10 | 0.15 | 0.13 | 0.04 | -29.82 | -31.83 | -28.95 | 2.88 | 29.71 | 0.00 | 0.00 | 0.01 |
| 1928.0000 | 0.11 | 0.10 | 0.15 | 0.13 | 0.04 | -30.06 | -32.07 | -29.18 | 2.88 | 29.73 | 0.00 | 0.00 | 0.01 |
| 1929.0000 | 0.11 | 0.11 | 0.15 | 0.13 | 0.04 | -30.41 | -32.42 | -29.53 | 2.89 | 29.75 | 0.00 | 0.00 | 0.01 |
| 1930.0000 | 0.12 | 0.11 | 0.15 | 0.13 | 0.04 | -30.87 | -32.89 | -29.99 | 2.90 | 29.76 | 0.00 | 0.00 | 0.01 |
| 1934.0000 | 0.12 | 0.11 | 0.15 | 0.13 | 0.04 | -31.45 | -33.47 | -30.56 | 2.91 | 29.80 | 0.00 | 0.00 | 0.01 |
| 1938.0000 | 0.12 | 0.11 | 0.15 | 0.13 | 0.04 | -32.14 | -34.16 | -31.24 | 2.92 | 29.85 | 0.00 | 0.00 | 0.01 |
| 1942.0000 | 0.12 | 0.11 | 0.15 | 0.13 | 0.04 | -32.94 | -34.97 | -32.04 | 2.93 | 29.90 | 0.00 | 0.00 | 0.01 |
| 1946.0000 | 0.12 | 0.11 | 0.15 | 0.13 | 0.04 | -33.77 | -35.81 | -32.86 | 2.95 | 29.94 | 0.00 | 0.00 | 0.01 |
| 1950.0000 | 0.12 | 0.11 | 0.15 | 0.13 | 0.04 | -34.60 | -36.65 | -33.68 | 2.97 | 29.99 | 0.01 | 0.00 | 0.01 |
| 1954.0000 | 0.12 | 0.11 | 0.15 | 0.13 | 0.04 | -35.42 | -37.49 | -34.50 | 2.99 | 30.06 | 0.01 | 0.00 | 0.01 |
| 1958.0000 | 0.12 | 0.11 | 0.15 | 0.13 | 0.04 | -36.25 | -38.33 | -35.32 | 3.01 | 30.15 | 0.01 | 0.00 | 0.01 |
| 1962.0000 | 0.12 | 0.11 | 0.15 | 0.13 | 0.04 | -37.08 | -39.18 | -36.15 | 3.04 | 30.24 | 0.01 | 0.00 | 0.01 |
| 1966.0000 | 0.12 | 0.11 | 0.15 | 0.13 | 0.04 | -37.95 | -40.07 | -37.01 | 3.06 | 30.35 | 0.01 | 0.00 | 0.01 |
| 1970.0000 | 0.12 | 0.11 | 0.15 | 0.13 | 0.03 | -38.86 | -41.00 | -37.91 | 3.10 | 30.47 | 0.01 | 0.00 | 0.00 |
| 1975.0000 | 0.12 | 0.11 | 0.15 | 0.13 | 0.03 | -39.81 | -41.98 | -38.84 | 3.13 | 30.66 | 0.01 | 0.00 | 0.00 |
| 1980.0000 | 0.12 | 0.12 | 0.15 | 0.13 | 0.03 | -40.79 | -42.99 | -39.81 | 3.18 | 30.87 | 0.01 | 0.00 | 0.00 |
| 1985.0000 | 0.12 | 0.12 | 0.15 | 0.13 | 0.03 | -41.77 | -44.00 | -40.78 | 3.22 | 31.11 | 0.01 | 0.00 | 0.00 |
| 1990.0000 | 0.11 | 0.12 | 0.14 | 0.13 | 0.03 | -42.62 | -44.87 | -41.62 | 3.26 | 31.38 | 0.01 | 0.00 | 0.01 |
| 1995.0000 | 0.11 | 0.12 | 0.14 | 0.13 | 0.03 | -43.31 | -45.59 | -42.30 | 3.29 | 31.67 | 0.01 | 0.00 | 0.00 |
| 1996.0000 | 0.11 | 0.12 | 0.14 | 0.13 | 0.03 | -43.85 | -46.15 | -42.84 | 3.31 | 31.73 | 0.01 | 0.00 | 0.00 |
| 1997.0000 | 0.11 | 0.12 | 0.14 | 0.13 | 0.03 | -44.25 | -46.56 | -43.23 | 3.33 | 31.78 | 0.01 | 0.00 | 0.00 |
| 1998.0000 | 0.11 | 0.12 | 0.14 | 0.13 | 0.03 | -44.49 | -46.81 | -43.47 | 3.34 | 31.84 | 0.00 | 0.00 | 0.00 |
| 1999.0000 | 0.11 | 0.12 | 0.14 | 0.13 | 0.03 | -44.70 | -47.03 | -43.67 | 3.35 | 31.92 | 0.00 | 0.00 | 0.00 |
| 2000.0000 | 0.11 | 0.12 | 0.14 | 0.13 | 0.03 | -44.90 | -47.24 | -43.88 | 3.36 | 31.97 | 0.01 | 0.01 | 0.00 |
| | Flat. (1930.0000-1995.0000 MHz) | | | | | | | | | | | | |
| | 0.00 | 0.01 | 0.01 | | | | | | | | | | |

*Fig. 4*

TUNABLE MICROSTRIP AND T-JUNCTION

BACKGROUND OF THE INVENTION

1. Field of the Invention

The present invention relates generally to tunable T-junctions and more particularly to tunable microstrips having multiple high frequency contactless tuning stubs and the use of such tunable microstrips to fabricate tunable T-junctions.

2. Description of the Prior Art

A microstrip is a type of electrical transmission line which can be fabricated using printed circuit board technology and is used to convey microwave-frequency signals. It consists of a conducting strip separated from a ground plane by a dielectric layer known as the substrate. For many applications, microstrips can be formed on pc boards from the metallization layers and the insulating body or substrate. Generally pc boards are made from copper and fiberglass, although for high frequency applications other materials with higher conductivity and higher dielectric values may be used. Microwave components such as antennas, couplers, filters, splitters and combiners can be formed from microstrips, the entire device existing as the pattern of metallization on the substrate. Microstrips are thus much less expensive than traditional waveguide technology, as well as being far lighter and more compact.

Tuning stubs and T-junctions are well known in the microwave industry. The first tuning stubs and T-junctions were mostly used in tuning devices for load pull measurements, in microwave antennas as a mechanism to control the resonant frequency, in matching networks to adjust the matching impedance, in filters as a means to adjust the center frequency, and in phase shifters to provide some degree of phase trimming. On the other hand, T-junctions alone have been widely used as either low loss splitters or combiners, but have seldom been tuned for any specific parameter.

T-junction power dividers/combiners are three port lossless devices and as such do not present isolation between the two output ports and only the sum port is matched. The lossless characteristic of T-junctions makes them suitable when there is a need for efficient power combining between two highly coherent power amplifiers. Efficiently performing such power combining relies on the loss properties of the dielectric material, the conductive trace's metallization technology as well as keeping as low as possible the amplitude and phase unbalances induced by the junction. Additionally, the sources to be combined must be as coherent as possible. T-junction devices have been implemented for decades in waveguide, stripline, coplanar and microstrip technologies among others and all of them follow the same principle of operation.

While microstrips and microstrip based T-junctions are easily manufactured on pc boards, achieving highly accurate parameter matching is not simple. The etching of microstrip circuit lines during manufacturing is frequently uneven due to manufacturing process variables and tolerances. The uneven etching leads to the circuit lines having different line widths. The uneven line widths cause impedance differences in the circuit lines and thus cause the insertion loss between the input port and output port to be different. The uneven line widths also cause amplitude unbalance between the input port and output port. Amplitude unbalance degrades the electrical performance of the combiner. The amount of amplitude unbalance is an important parameter in defining the performance of the combiner. Various tuning strategies have been used in high frequency stripline devices.

U.S. Pat. No. 7,015,772 entitled TUNABLE AMPLITUDE UNBALANCE STRIPLINE COMBINER teaches a tuned T-junction using windows cut into the ground plane of a stripline circuit to tune the signal amplitudes and thus minimize the amplitude unbalance. In this circuit tuning stubs were not used. There is no optimization for voltage breakdown or for the dynamic range of tuning. The circuit area required to realize this tuning method is further complicated by the need to remove significant amounts of material, thus increasing time and effort to tune the circuit.

U.S. Pat. No. 6,946,999 entitled TUNING TABS FOR A MICROSTRIP ANTENNA teaches a microstrip antenna tunable over a specified frequency range by the addition or removal of eight tuning tabs. While this means of tuning yields a relatively smooth control over the desired frequency range, two precisely aligned printed circuit boards are required to realize the device.

U.S. Pat. No. 6,759,917 entitled METHOD AND APPARATUS FOR ADJUSTING IMPEDANCE OF MATCHING CIRCUIT teaches a tuning method for a matching network, involving cutting and removing portions of stubs extending from signal traces. While this tuning method may permit extremely fine resolution, it directly affects the characteristics of the signal traces through the stubs and requires relatively complex equipment in order to make the necessary cuts in the stubs.

U.S. Pat. No. 6,005,519 entitled TUNABLE MICROSTRIP ANTENNA AND METHOD FOR TUNING THE SAME teaches a patch antenna with multiple smaller patches being either connected or disconnected from the main patch and from each other in order to control the effective length and width of the antenna. While this tuning method provides good control over bandwidth, resonant frequency and wave polarization, it does not permit contactless tuning of a microstrip with optimized dimensions.

U.S. Pat. No. 5,982,251 entitled TUNER FOR RADIO FREQUENCY TRANSMISSION LINES teaches a length of coaxial line with a single movable capacitive stub mounted alongside. The capacitive stub is micrometer-controlled for radial and axial position relative to the center conductor and interacts with the center conductor through a slit in the outer shield, thus providing tuning capability. This tuning method is not applicable to printed circuit boards and requires complex mechanical devices to be permanently incorporated into the tuned element.

So far, none of the existing T-junction designs intended for high power, low loss and highly coherent applications have been implemented in a microstrip technology with tuning capabilities for amplitude unbalance. Furthermore, none of the existing T-junction designs provide a tunable, low loss, high power handling and highly coherent T-junction (lossless power splitter/combiner) implemented in microstrip technology, where contactless tuning stubs are employed and where the tuning stub shape has been carefully engineered to maximize tuning capabilities while minimizing voltage breakdown phenomena.

A higher-performing tunable microstrip and T-junction design would rely on removable contactless tuning stubs wherein during tuning stub removal, the signal trace would not be touched and thus the carefully optimized dimensions of the signal trace would not be changed. To prevent contactless tuning stubs in a high voltage environment from experiencing voltage breakdown, an optimized shape would prevent voltage breakdown below 1.3 kV. While employing this optimized shape, the tuning stubs would provide a 0.4 dB amplitude unbalance tuning range to the T-junction circuit, and a tuning resolution of at least 0.02 dB. A higher-performing tunable microstrip and T-junction design would also make it feasible to produce large volumes of such devices both cost-effectively and with tightly controlled specs.

SUMMARY

A tunable microstrip comprises a microstrip having a signal trace, a ground plane, and a dielectric layer intermediate the signal trace and the ground plane, where in close proximity to each side of the signal trace there is a plurality of grounded tuning stubs, connected by a grounding bus. These grounding busses are electrically connected to the ground plane by a plurality of electrically conductive vias. The microstrip is tuned by removing at least one of the tuning stubs. The tuning resolution of each tuning stub is 0.02 dB.

The grounded tuning stubs are shaped with no sharp edges in order to minimize high density field zones, and the distance between the grounded tuning stubs and the signal trace is approximately 25 mils. The minimum breakdown voltage is 1.3 kV. Preferably, there are three tuning stubs on one side of the signal trace and five tuning stubs on the other side of the signal trace. For manufacturing purposes, the tunable microstrip is fabricated on a printed circuit board comprising a sandwich of conductive layers with an insulating core therebetween, where the conductive layers comprise reversed copper and silver immersion and the insulating core comprises a woven matrix of fiberglass fabric coated with Polytetrafluoroethylene.

Using the tunable microstrip of the present invention, a highly balanced T-junction is constructed using three microstrips wherein at least one microstrip is tunable, though preferably all three microstrips are tunable to improve amplitude balance. The tuning range for the T-junction is 0.4 dB.

The method for balancing the T-junction using tunable microstrips is as follows:

A T-junction circuit is provided having a first signal port electrically connected to one end of a first tunable microstrip having a signal trace with a plurality of grounded tuning stubs in proximity to the signal trace, a second signal port electrically connected to one end of a second tunable microstrip having a signal trace with a plurality of grounded tuning stubs in proximity to the signal trace, a third signal port electrically connected to one end of a third tunable microstrip having a signal trace with a plurality of grounded tuning stubs in proximity to the signal trace, the other ends of each of the tunable microstrips being commonly connected to a common signal port. The insertion losses are measured between the first signal port and the common signal port. The insertion losses are then measured between the second signal port and the common signal port. The insertion losses are then measured between the third signal port and the common signal port. The lowest of the insertion losses is identified. At least a portion of the tuning stubs in proximity to the tunable microstrip having the lowest insertion loss are removed.

The method of tuning a highly balanced T-junction circuit may further comprise re-measuring all three sets of insertion losses, determining that further tuning is needed in order to reach a specified unbalance range, identifying the lowest of the insertion losses, and removing at least a portion of the remaining tuning stubs in proximity to the tunable microstrip having the lowest insertion loss.

The method of tuning a highly balanced T-junction circuit may also comprise determining that two of the tunable microstrips have almost identically low insertion losses and one microstrip has a comparatively high insertion loss, and, removing at least a portion of the tuning stubs for both of the tunable microstrips having the lowest insertion losses.

OBJECTS AND FEATURES OF THE INVENTION

It is an object of the present invention to provide a tunable T-junction having an amplitude unbalance tuning resolution of at least 0.02 dB.

It is another object of the present invention to provide a tunable T-junction having an overall tuning range of 0.4 dB.

It is yet another object of the present invention to provide a tunable T-junction having a minimum breakdown voltage of 1.3 kV.

It is still another object of the present invention to provide a tunable T-junction that can be manufactured and tuned with standard printed circuit board materials.

It is a feature of the present invention to provide tunable microstrips for each leg of the T-junction.

It is another feature of the present invention to have a plurality of contactless tuning stubs for each tunable microstrip.

It is yet another feature of the present invention to have tuning stubs shaped to minimize high density electric field zones.

BRIEF DESCRIPTION OF THE DRAWINGS

The present version of the invention will be more fully understood with reference to the following Detailed Description in conjunction with the drawings of which:

FIG. 4 is a chart showing the actual test data performance of the unit after tuning; and, FIG. 5 shows the electromagnetic field between the tuning stubs and a microstrip trace.

DESCRIPTION OF THE PREFERRED EMBODIMENTS

Figure 1:
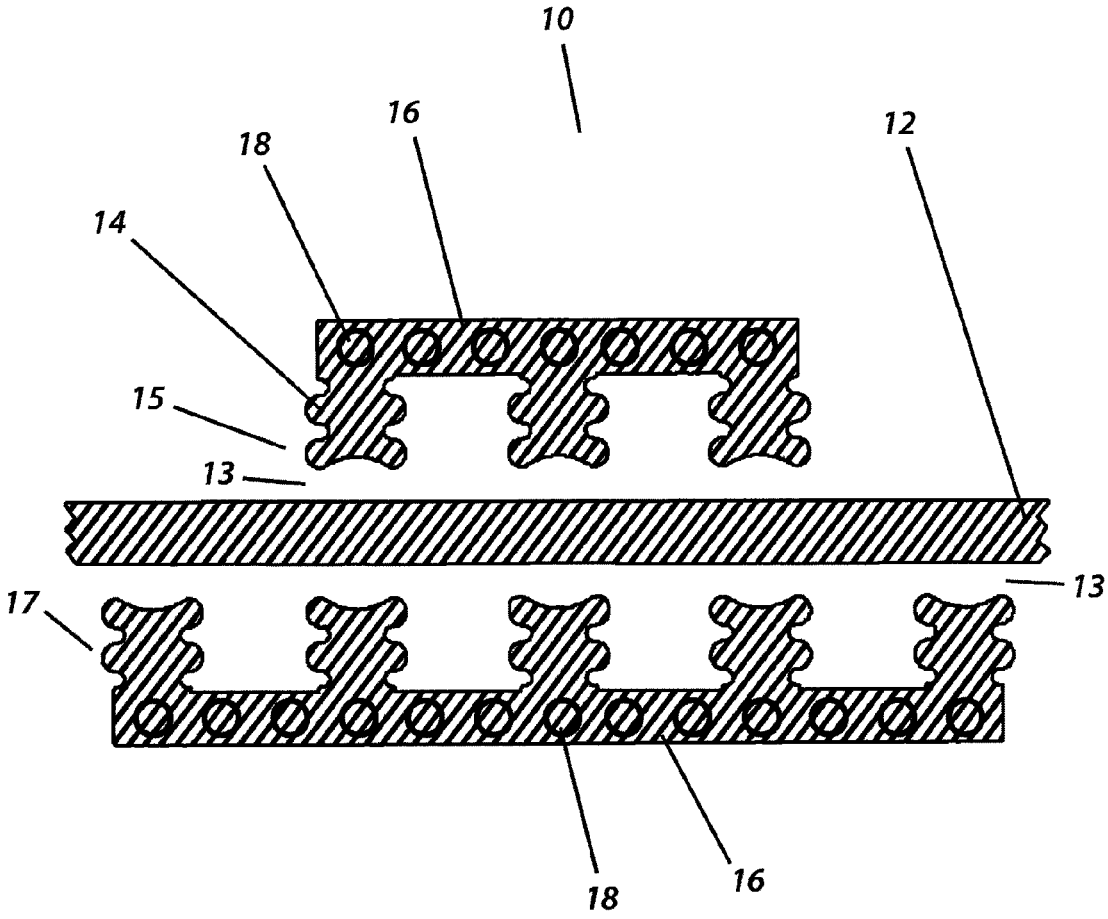
FIG. 1 is a diagram of tuning stubs bordering a microstrip trace.

A tunable microstrip 10 is shown in FIG. 1. The signal trace 12 is formed over one side of a dielectric sheet (not shown) and the other side of the dielectric sheet is covered with a ground plane. Tuning stubs 14 are located in close proximity on both sides of the trace 12 but with an insulating gap 13. The groups of three tuning stubs 15 and five tuning stubs 17 on each side of the signal trace 12 are each joined by a ground bus 16, which is electrically connected to the ground plane on the other side of the dielectric sheet by tuning stub ground vias 18. The tuning stubs 14 are preferably placed at a distance of around 25 mils from the signal trace 12, thus providing a contactless electromagnetic interaction. Feature geometry along each one of the tuning stub 14 branches has been carefully selected through an optimization process using electromagnetic simulation. The tuning stubs 14 have been carefully shaped so that high density electric field zones are minimized, while maintaining an adequate gap distance to the signal trace 12 such that the tuning capabilities per tuning stub 14 are maximized and voltage breakdown is minimized. In the present invention, a minimum high voltage breakdown of 1.3 kV is maintained. Each tuning stub 14 adds some capacitance to the signal trace 12, slightly changing the characteristic impedance of the signal trace 12. A tuning stub 14 is removed by slicing it loose from the ground bus 16 and then peeling it off the dielectric sheet.

Any variation of the tuning stub geometry will produce a change in the behavior of the circuit, but in order to accurately quantify such a change, it is necessary to define a "standard" removal portion of the tuning stub. It was found that completely removing one tuning stub could improve the amplitude unbalance by between 0.01 dB and 0.02 dB. Ultimately, there is a compromise to be made between maximum tuning sensitivity and breakdown voltage, and a maximum tuning sensitivity of 0.01 dB is sufficient while also allowing an acceptable breakdown voltage to be maintained. Thus, there is no real benefit in removing only a portion of a tuning stub.

Figure 5:
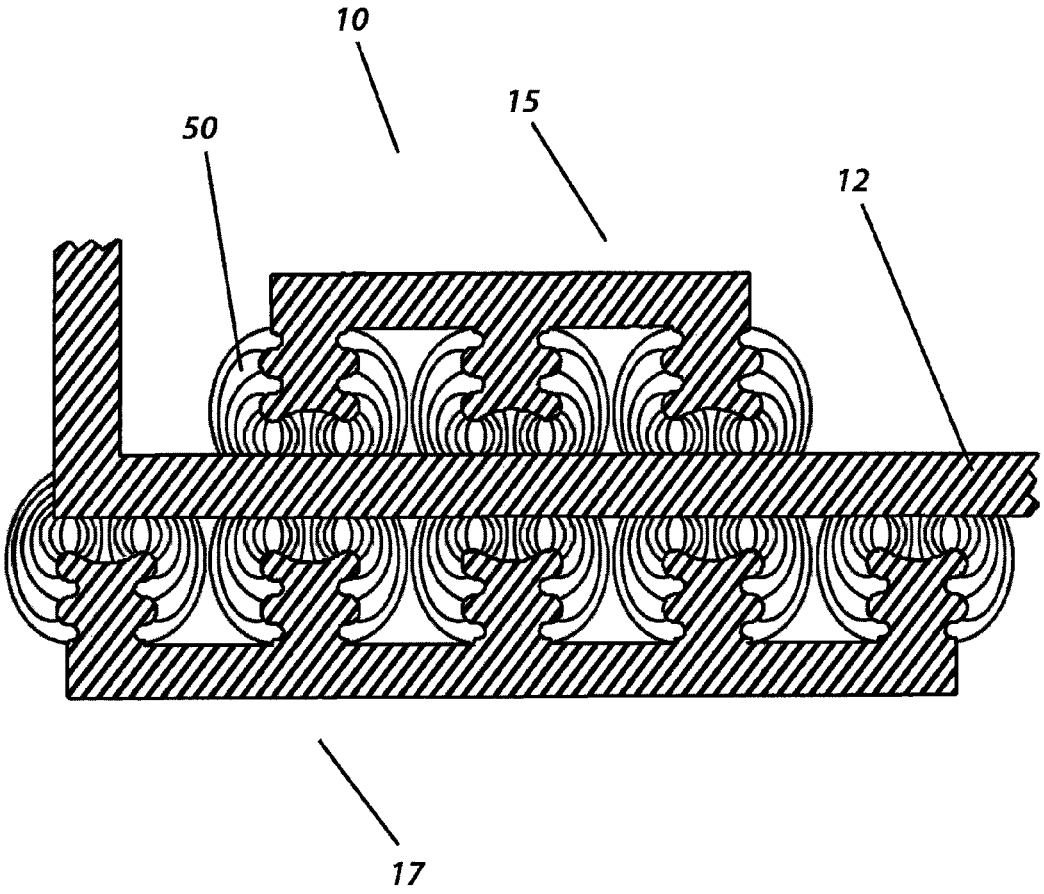

FIG. 5 shows the electromagnetic field 50 between the tuning stubs 14 and the signal trace 12. The electromagnetic performance of the tuning stub is dependent upon parameters including tuning stub shape and distance to the signal trace, and can be described through an understanding of basic principles of electromagnetics. By eliminating or reducing the generation and accumulation of electrical charge, higher breakdown voltages between objects can be achieved. The accumulation of electrical charge is caused by factors including material type, gaps between dissimilar materials, and gaps between similar materials at different voltage potentials. Angular or sharp-edge shaped conductors will tend to have greater charge differentials between the smooth edges and the angular or sharp edges. The highest charge densities are present at the sharp edges. Thus, gently curved edges are best suited for even distribution of electrical charge and will allow the fastest redistribution of charge along the conductor edge to prevent uneven charge distribution. Breakdown voltage levels can also be improved by lengthening the discharge path. Making the edge contour of the tuning stub follow a sinusoidal path is an ideal way to lengthen the discharge path without increasing charge differential along the tuning stub edge.

The breakdown electric field strength in air is approximately 30 kV/cm. In order to achieve a maximum voltage difference of 1.5 kV between the signal trace and the tuning stub surface, the air gap needs to be at least 1.5 kV/(30 kV/cm)=0.5 mm or 0.020". Setting the gap to 0.025" gives a reasonable safety margin for use in high humidity conditions where the breakdown electric field strength is lower. Specifying the maximum breakdown voltage as 1.3 kV provides an improved safety margin for real-world use.

The distance between the signal trace and the tuning stubs also directly affects the tuning stub capacitance and thus the characteristic impedance of the signal trace. Placing the tuning stubs closer to the signal trace results in a higher capacitance and thus a higher characteristic impedance. Thus, the closer the tuning stub is to the signal trace, the greater the magnitude of change in amplitude unbalance that can be achieved by removing the tuning stub, although at the expense of a lower breakdown voltage as this distance is decreased. The present invention provides a tuning effect of 0.01 dB to 0.02 dB per tuning stub with a specified voltage breakdown of 1.31N, which represents an ideal compromise between tuning resolution and breakdown voltage.

Figure 2A:
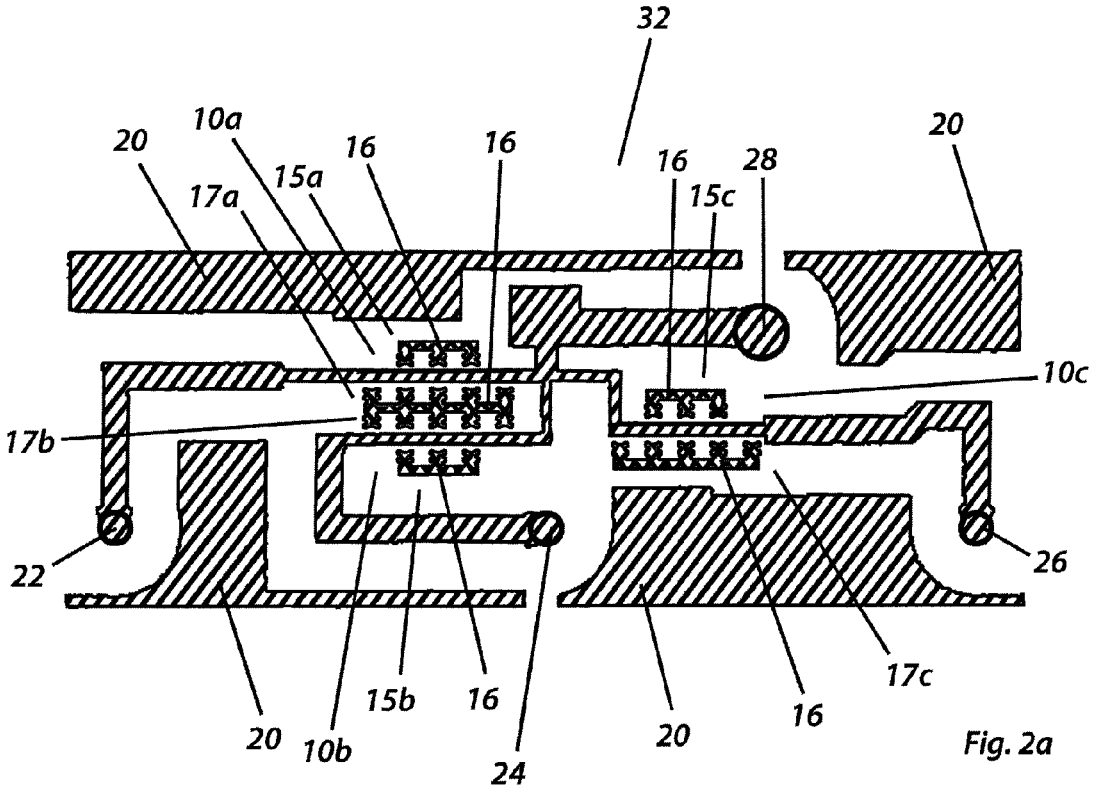
FIG. 2*a* is a top view of a tunable T-junction.
Figure 2B:
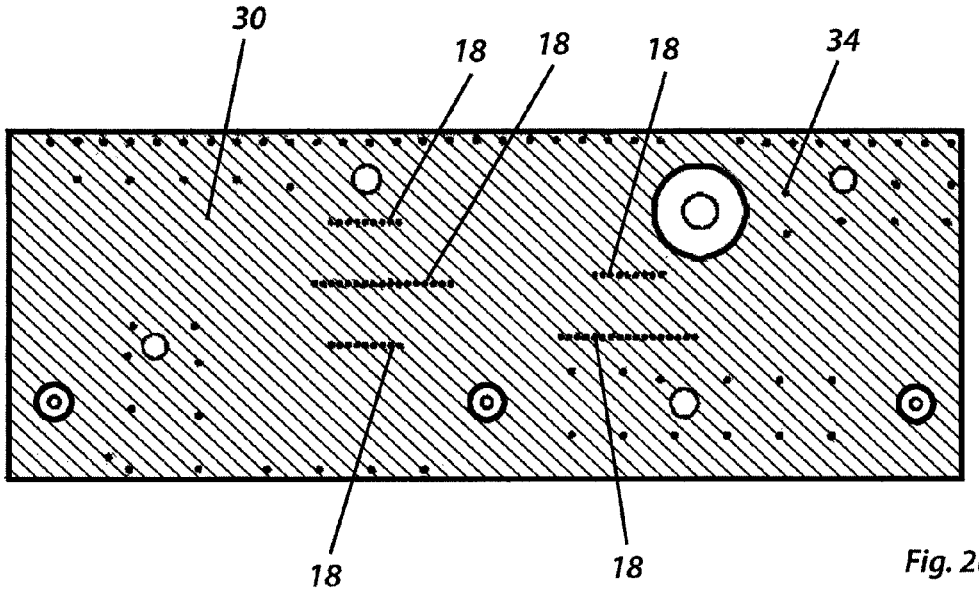
FIG. 2*b* is a top view of the grounding plane for a tunable T-junction.

A tunable T-junction circuit 32 incorporating multiple tunable microstrips 10*a*, 10*b*, and 10*c* is shown in FIG. 2*a*, with FIG. 2*b* showing the lower ground plane 30 laid out on the underside of the substrate. Connector terminal pads 22, 24 and 26 provide signal input and output connection points, and terminal pad 28 provides a common connection between all three legs of the T-junction. Tunable microstrip 10*a* is connected to terminal pad 22 at one end and to terminal pad 28 at the other end. Tunable microstrip 10*b* is connected to terminal pad 24 at one end and to terminal pad 28 at the other end. Tunable microstrip 10*c* is connected to terminal pad 26 at one end and to terminal pad 28 at the other end. Tunable microstrip 10*a* has groups of tuning stubs 15*a* and 17*a*. Tunable microstrip 10*b* has groups of tuning stubs 15*b* and 17*b*. Tunable microstrip 10*c* has groups of tuning stubs 15*c* and 17*c*. Each group of tuning stubs shares a ground bus 16. All of the widths and lengths of each one of the signal paths are selected so that excellent electrical performance is achieved when all of the tuning stubs 14 are grounded. In case there is a noticeable imperfection in the signal trace 12 layout which is evident by a high amplitude unbalance reading, then tuning stubs 14 acting on the lowest insertion loss branch are selectively removed to decrease the unbalance. By removing one tuning stub 14, amplitude unbalance can be improved in the range of 0.01 to 0.02 dB. Altogether, selective removal of the tuning stubs 14 provides a capability of tuning amplitude unbalance up to 0.4 dB. Note that as shown, groups of tuning stubs such as tuning stubs 17*a* and 17*b* can share a ground bus 16. An upper ground plane 20 surrounds much of the tunable T-junction circuit 32 to provide shielding, and additional ground vias 34 connect the upper ground plane 20 and the lower ground plane 30.

Figure 3A:
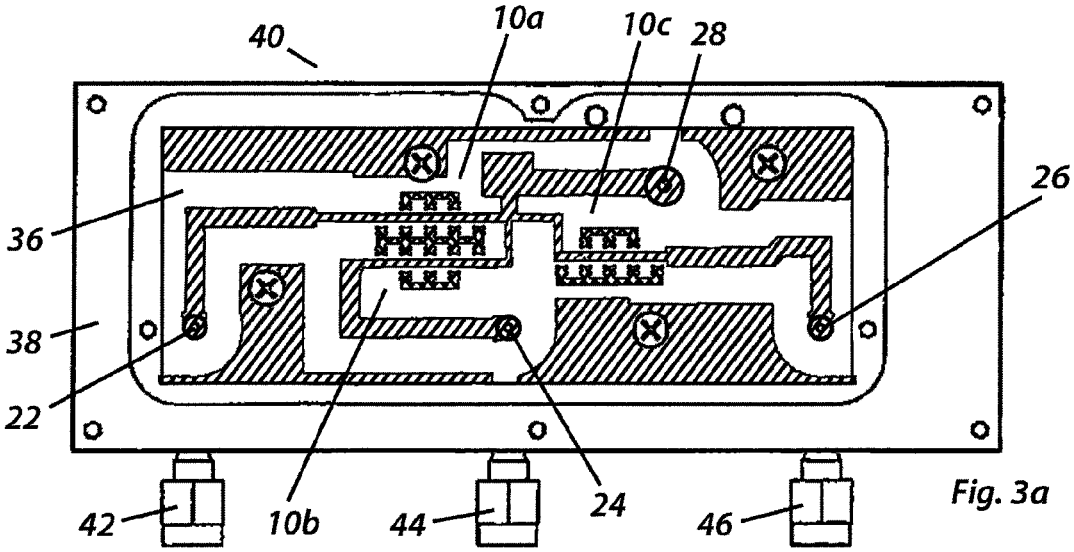
FIG. 3*a* is a top view of a test circuit for a tunable T-junction.
Figure 3B:
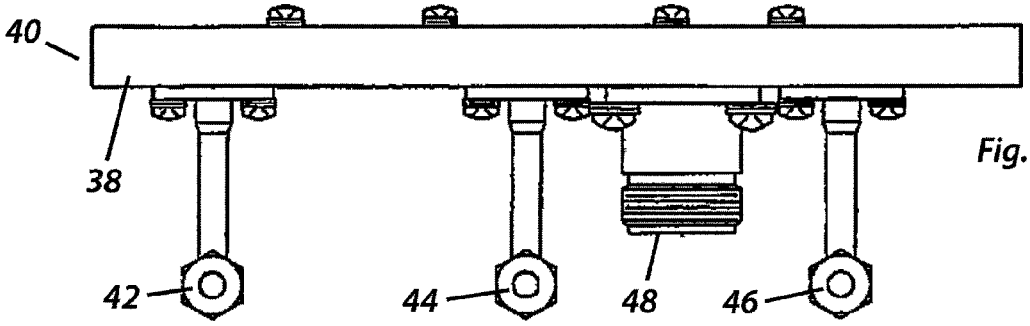
FIG. 3*b* is a is a plan view of a test circuit for a tunable T-junction.
Figure 3C:
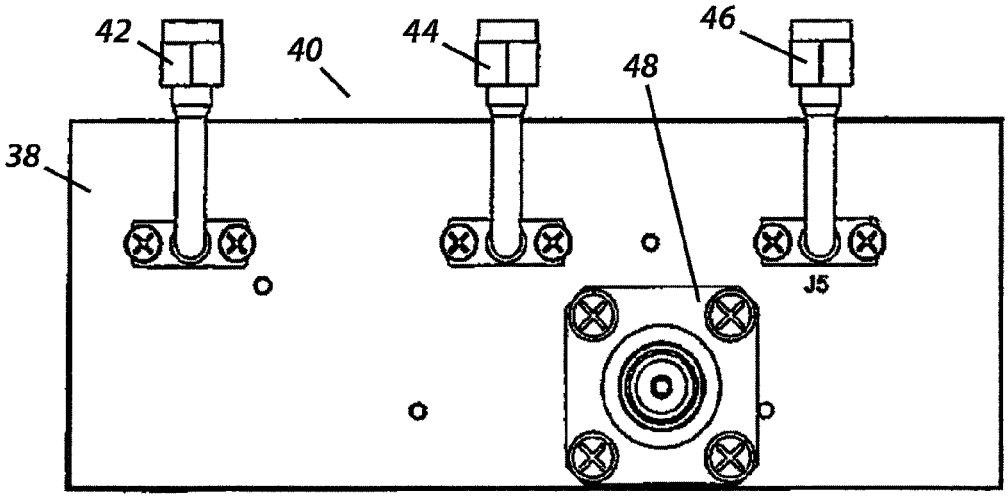
FIG. 3*c* is a bottom view of a test circuit for a tunable T-junction.

The tunable T-junction test circuit 40 shown in FIGS. 3*a*, 3*b* and 3*c* is the circuit of FIGS. 2*a* and 2*b* laid out on a printed circuit board 36 which is mounted on a base plate 38. The test circuit 40 includes a first coaxial connector 42 connected to terminal pad 22, a second coaxial connector 44 connected to terminal pad 24, and a third coaxial connector 46 connected to terminal pad 26. A fourth coaxial connector 48 is connected to the common connection at terminal pad 28. The width of the microstrip signal traces is in the range of 0.032" to 0.037" and the thickness of the printed circuit board dielectric layer is approximately 0.062".

The method for tuning the T-junction circuit for minimum amplitude unbalance is as follows:

1. Measure the insertion losses between connector 48 and connector 42, connector 48 and connector 44, connector 48 and connector 46.

2. Identify the lowest of the three insertion losses.

3a. If the section of circuit between connector 48 and connector 42 has the lowest insertion loss, then remove the three tuning stubs 15*a* by cutting them from the ground bus 16 and peeling them loose from the board 36.

3b. If the section of circuit between connector 48 and connector 44 has the lowest insertion loss, then remove the three tuning stubs 15*b* by cutting them from the ground bus 16 and peeling them loose from the board 36.

3a. If the section of circuit between connector 48 and connector 46 has the lowest insertion loss, then remove the three tuning stubs 15*c* by cutting them from the ground bus 16 and peeling them loose from the board 36.

4. If two circuit paths both have almost identically low insertion losses and one path has a high insertion loss, then remove three tuning stubs 15 from each low insertion loss circuit path, per the instructions of section 3.

5. If additional amplitude unbalance correction is needed, individual tuning stubs can be removed from the groups of five tuning stubs 17 until an acceptable balance condition is reached.

In the preferred embodiment, the substrate is a high quality dielectric material such as 62 mil thick Taconic TLP-5, with conductive layers formed from reversed copper and silver immersion. The tuning stubs of the present invention combined with an optimized high frequency circuit layout allow for a high volume production of power splitters/combiners with outstanding electrical performance within the 1930-1995 MHz frequency band. The performance specs that are achieved include: Average Combined Power of 360 W, Peak Envelope Power of 2500 W, Output VSWR of 1.2:1 Max, Insertion Loss Avg. (Above 4.77 dB) of 0.25 dB Max, Minimum Isolation between ports of 8.8 dB, Maximum Amplitude Unbalance of 0.2 dB, Maximum Phase Unbalance of 6°, Maximum Insertion Loss Flatness of 0.2 dB P-P and a Minimum Breakdown Voltage of 1.3 kV. It is worth noting that while the tuning stubs of the present invention are used to tune for amplitude unbalance, the tuning stubs used with antennas are used to tune for frequency.

FIG. 4 shows the actual test data performance of the unit after tuning. Specifically, FIG. 4 shows the achieved insertion loss per branch, the average insertion loss among all of the branches, (above a theoretical value of 4.77 dB) the achieved amplitude unbalance between all of the output powers of the circuit of FIGS. 3*a*, 3*b* and 3*c*, the insertion phase per branch, the total phase unbalance among all of the branches, the input return loss and the measured group delay for each one of the branches. This table summarizes the achievable electrical performance of the circuit of FIGS. 3*a*, 3*b* and 3*c* when fully tuned per the stated tuning method, and measured with appropriate electrical test equipment.

An alternate embodiment of the present invention has some but not all legs of the T-junction composed of tunable microstrips. This reduces tuning capability but also reduces unit size and cost.

Another alternate embodiment of the present invention has the tuning stubs and signal trace configured so that there is a near constant distance between the tuning stubs and the signal trace. In this embodiment the signal trace is contoured to match the shape of the tuning stubs.

The amplitude unbalance variation per tuning stub is highly predictable making the device easy and quick to be tuned. The tuning mechanism is passive so no power consumption is involved in tuning. The tuning mechanism is also robust in that the circuit cannot accidentally become detuned. The present invention allows the production of a T-junction style power splitter/combiner in high volumes with high yield and excellent electrical specs while exhibiting a very low insertion loss, very high power handling, very coherent combining capability and all of the above at a low cost.

Having described herein illustrative embodiments and best mode of the present invention, persons of ordinary skill in the art will appreciate various other features and advantages of the invention apart from those specifically described above. It should therefore be understood that the foregoing is only illustrative of the principles of the invention, and that various modifications and additions can be made by those skilled in the art without departing from the spirit and scope of the invention. Accordingly, the appended claims shall not be limited by the particular features that have been shown and described, but shall be construed also to cover any obvious modifications and equivalents thereof.

What is claimed is:

1. A tunable microstrip comprising:

a microstrip having a signal trace, a ground plane and a dielectric layer intermediate said signal trace and said ground plane;

a plurality of grounded tuning stubs in proximity to at least one side of said signal trace;

said plurality of tuning stubs being electrically connected to at least one grounding bus; and said grounding bus being electrically connected to said ground plane through said dielectric layer by a plurality of vias.

2. The tunable microstrip as described in claim 1, wherein said microstrip is tuned by selectively removing at least one of said tuning stubs.

3. The tunable microstrip as described in claim 2, wherein each of said tuning stubs provides a tuning resolution of at least 0.02 dB.

4. The tunable microstrip as described in claim 2, wherein said tuning stubs are shaped to minimize high density field zones.

5. The tunable microstrip as described in claim 4, wherein said tuning stub comprises a shape having no sharp edges.

6. The tunable microstrip as described in claim 5, wherein said tuning stub comprises a shape having sinusoidally patterned edges.

7. The tunable microstrip as described in claim 2, wherein said signal trace is configured to have a near constant distance to a periphery of said tuning stubs.

8. The tunable microstrip as described in claim 5, wherein a breakdown voltage is at least 1.3 kV.

9. The tunable microstrip as described in claim 2, wherein:

said plurality of grounded tuning stubs is a first plurality of grounded tuning stubs in proximity to a first side of said signal trace and a second plurality of grounded tuning stubs in proximity to a second side of said signal trace;

said grounding bus being a first grounding bus and a second grounding bus;

said first plurality of tuning stubs being electrically connected by said first grounding bus; and said second plurality of tuning stubs being electrically connected by said second grounding bus.

10. The tunable microstrip as described in claim 9, wherein said first plurality of tuning stubs is at least three tuning stubs and said second plurality of tuning stubs is at least five tuning stubs.

11. The tunable microstrip as described in claim 9, wherein said tunable microstrip is fabricated on a printed circuit board comprising a sandwich of conductive layers with an insulating core therebetween.

12. The tunable microstrip as described in claim 11, wherein said conductive layers comprise reversed copper and silver immersion and said insulating core comprises a woven matrix of fiberglass fabric coated with Polytetrafluoroethylene.

13. A tunable microstrip comprising:

a printed circuit board having a first conductive layer and a second conductive layer, said conductive layers comprising reversed copper and silver immersion;

said printed circuit board further having a dielectric layer intermediate said conductive layers; said dielectric layer comprising a woven matrix of fiberglass fabric coated with Polytetrafluoroethylene;

a microstrip having a signal trace formed from said first conductive layer, and a ground plane formed from at least a portion of said second conductive layer;

at least three grounded tuning stubs formed from a portion of said first conductive layer in proximity to a first side of said signal trace;

at least five grounded tuning stubs formed from a portion of said first conductive layer in proximity to a second side of said signal trace;

said first plurality of tuning stubs being electrically connected by a first grounding bus;

said second plurality of tuning stubs being electrically connected by a second grounding bus;

said first and said second grounding buses being electrically connected to said ground plane through said dielectric layer by a plurality of vias;

wherein each of said tuning stubs provides a tuning resolution of at least 0.02 dB;

wherein said tuning stubs comprise a shape having sinusoidally patterned edges thereby minimizing high density field zones;

whereby said tunable microstrip has a breakdown voltage of at least 1.3 kV; and whereby said tunable microstrip is tuned by selectively removing at least one of said tuning stubs.

14. A highly balanced T-junction comprising:

first microstrip having a first signal trace intermediate and electrically connected to a first port and a second port;

a second microstrip having a second signal trace intermediate and electrically connected to a third port and a fourth port;

a third microstrip having a third signal trace intermediate and electrically connected to a fifth port and a sixth port;

said microstrips all having a common ground plane and a common dielectric layer intermediate said ground plane and said signal traces;

said second port, said fourth port and said fifth port are electrically connected; and at least one of said microstrips being a tunable microstrip.

15. The highly balanced T-junction as described in claim 14, wherein said tunable microstrip has a plurality of grounded tuning stubs in proximity to said signal trace, said tuning stubs being electrically connected to at least one grounding bus; and said grounding bus being electrically connected to said ground plane.

16. The highly balanced T-junction as described in claim 14, further comprising:

said tunable microstrip having a first plurality of grounded tuning stubs in proximity to a first side of said signal trace and a second plurality of grounded tuning stubs in proximity to a second side of said signal trace;

each of said plurality of tuning stubs being electrically connected by a grounding bus; and said grounding buses being electrically connected to said ground plane.

17. The highly balanced T-junction as described in claim 16, wherein each of said grounding busses are electrically connected to said ground plane through said dielectric layer by a plurality of vias.

18. The highly balanced T-junction as described in claim 16, wherein said tunable microstrip is tuned by removing at least one of said tuning stubs.

19. The highly balanced T-junction as described in claim 18, wherein each of said tuning stubs provides a tuning resolution of at least 0.02 dB.

20. The highly balanced T-junction as described in claim 18, wherein said tuning stubs are shaped to minimize high density field zones.

21. The highly balanced T-junction as described in claim 20, wherein said tuning stubs comprise a shape having no sharp edges.

22. The tunable microstrip as described in claim 21, wherein said tuning stubs comprise a shape having sinusoidally patterned edges.

23. The highly balanced T-junction as described in claim 21, wherein said signal trace is configured to have a near constant distance to a periphery of said tuning stubs.

24. The highly balanced T-junction as described in claim 21, wherein a breakdown voltage is at least 1.3 kV.

25. The highly balanced T-junction as described in claim 16, wherein each of said first plurality of tuning stubs is at least three tuning stubs and each of said second plurality of tuning stubs is at least five tuning stubs.

26. The highly balanced T-junction as described in claim 16, wherein said T-junction is fabricated on a printed circuit board comprising a sandwich of conductive layers with an insulating core therebetween.

27. The highly balanced T-junction as described in claim 26, wherein said conductive layers comprise reversed copper and silver immersion and said insulating core comprises a woven matrix of fiberglass fabric coated with Polytetrafluoroethylene.

28. A highly balanced T-junction comprising: a printed circuit board having a first conductive layer and a second conductive layer, said conductive layers comprising:

reversed copper and silver immersion;

said printed circuit board further having a dielectric layer intermediate said conductive layers, said dielectric layer comprising a woven matrix of fiberglass fabric coated with Polytetrafluoroethylene;

a first tunable microstrip having a first signal trace formed from said first conductive layer, said first microstrip intermediate and electrically connected to a first port and a second port;

a second tunable microstrip having a second signal trace formed from said first conductive layer, said second microstrip intermediate and electrically connected to a third port and a fourth port;

a third tunable microstrip having a third signal trace formed from said first conductive layer, said third microstrip intermediate and electrically connected to a fifth port and a sixth port;

said microstrips all having a common ground plane formed from said second conductive layer, and a common dielectric layer intermediate said ground plane and said signal traces;

said second port, said fourth port and said fifth port being commonly electrically connected;

each of said tunable microstrips having at least three grounded tuning stubs in proximity to a first side of said signal trace and at least five grounded tuning stubs in proximity to a second side of said signal trace;

each of said plurality of tuning stubs being electrically connected by a grounding bus;

said grounding buses being electrically connected to said ground plane through said dielectric layer by a plurality of vias;

wherein each of said tuning stubs provides a tuning resolution of at least 0.02 dB;

wherein said tuning stubs comprise a shape having sinusoidally patterned edges thereby minimizing high density field zones;

whereby said tunable microstrips have a breakdown voltage of at least 1.3 kV; and, wherein selectively removing at least one of said tuning stubs from at least one of said tunable microstrips provides a tuned reduction in signal unbalance between portions of said T-junction.

29. A method of tuning a highly balanced T-junction circuit, comprising:

(1) providing a T-junction circuit having a first signal port electrically connected to one end of a first tunable microstrip having a signal trace with a plurality of grounded tuning stubs in proximity to said signal trace, a second signal port electrically connected to one end of a second tunable microstrip having a signal trace with a plurality of grounded tuning stubs in proximity to said signal trace, a third signal port electrically connected to one end of a third tunable microstrip having a signal trace with a plurality of grounded tuning stubs in proximity to said signal trace, the other ends of each of said tunable microstrips being commonly connected to a common signal port;

(2) measuring insertion losses between said first signal port and said common signal port;

(3) measuring the insertion losses between said second signal port and said common signal port;

(4) measuring the insertion losses between said third signal port and said common signal port;

(5) identifying the lowest of said insertion losses; and, (6) removing at least a portion of said tuning stubs in proximity to said tunable microstrip having the lowest of said insertion losses.

30. The method of tuning a highly balanced T-junction circuit as described in claim 29, further comprising:

(1) re-measuring all three sets of insertion losses;

(2) determining that further tuning is needed in order to reach a specified unbalance range;

(3) identifying the lowest of said insertion losses; and, (4) removing at least a portion of the remaining tuning stubs in proximity to said tunable microstrip having the lowest of said insertion losses.

31. The method of tuning a highly balanced T-junction circuit as described in claim 29, further comprising:

(1) determining that two of said tunable microstrips have almost identically low insertion losses and one of said tunable microstrip has a comparatively high insertion loss; and, (2) removing at least a portion of said tuning stubs for both of said tunable microstrips having the lowest of said insertion losses.

* * * * *